US007402365B1

(12) United States Patent
Bailey et al.

(10) Patent No.: US 7,402,365 B1
(45) Date of Patent: Jul. 22, 2008

(54) THERMALLY TRANSFERABLE IMAGE PROTECTION OVERCOAT

(75) Inventors: David B. Bailey, Webster, NY (US); Peter D. Rollinson, Rochester, NY (US); Carol M. McDonald, Marion, NY (US); Jacob J. Hastreiter, Spencerport, NY (US)

(73) Assignee: Eastman Kodak Comapny, Rochester, NY (US)

( * ) Notice: Subject to any disclaimer, the term of this patent is extended or adjusted under 35 U.S.C. 154(b) by 0 days.

(21) Appl. No.: 11/739,289

(22) Filed: Apr. 24, 2007

(51) Int. Cl.
*G03C 11/08* (2006.01)
*G03C 11/10* (2006.01)

(52) U.S. Cl. ..... 430/14; 430/200; 430/201; 430/961; 428/32.11; 428/32.6; 428/32.72; 428/32.76; 428/32.79; 428/32.85; 503/227

(58) Field of Classification Search ..... 430/14, 430/200, 201, 961; 428/32.6, 32.72, 32.76, 428/32.11, 32.79, 32.85; 503/227
See application file for complete search history.

(56) References Cited

U.S. PATENT DOCUMENTS

| | | | |
|---|---|---|---|
| 4,522,881 | A | 6/1985 | Kobayashi et al. |
| 5,332,713 | A | 7/1994 | Oldfield et al. |
| 5,387,573 | A | 2/1995 | Oldfield et al. |
| 5,514,637 | A | 5/1996 | Lum et al. |
| 5,668,081 | A | 9/1997 | Simpson et al. |
| 5,670,449 | A | 9/1997 | Simpson et al. |
| 6,733,611 | B2 | 5/2004 | Hayashi et al. |
| 6,942,956 | B2 | 9/2005 | Simpson et al. |
| 2006/0068174 | A1 | 3/2006 | Sato |

FOREIGN PATENT DOCUMENTS

| | | |
|---|---|---|
| JP | 2825778 | 9/1998 |
| JP | 2006/021402 | 1/2006 |
| JP | 2006/095982 | 4/2006 |

*Primary Examiner*—Richard Schilling
(74) *Attorney, Agent, or Firm*—Lynne M. Blank

(57) ABSTRACT

The present invention relates to a protective heat transferable overcoat element comprising a support having thereon a protective polymer layer of at least one benzoated phenoxy resin of Formula I. The present invention also relates to a thermal transfer dye donor element comprising a support having on one side thereof at least one dye layer and a protective polymer layer of at least one benzoated phenoxy resin of Formula I and a thermal transfer assemblage comprising at least one thermal transfer donor element comprising a support having on one side thereof a protective polymer layer of at least one benzoated phenoxy resin of Formula I. Finally, the present invention relates to a protected image reproduction comprising a support, an imaging layer containing an image, and a transferred protective heat transferable overcoat comprising a protective polymer layer of at least one benzoated phenoxy resin of Formula I.

28 Claims, No Drawings

THERMALLY TRANSFERABLE IMAGE PROTECTION OVERCOAT

FIELD OF THE INVENTION

The present invention relates to a dye donor element for thermal dye transfer, and more particularly to the use of a transferable protection overcoat comprising a benzoated phenoxy resin for improved gloss of dye diffusion thermal transfer prints.

BACKGROUND OF THE INVENTION

In recent years, thermal transfer systems have been developed to obtain prints from pictures that have been generated electronically from a color video camera. According to one way of obtaining such prints, an electronic picture is first subjected to color separation by color filters. The respective color-separated images are then converted into electrical signals. These signals are then operated on to produce cyan, magenta and yellow signals. These signals are then transmitted to a thermal printer. To obtain the print, a cyan, magenta or yellow dye donor element is placed face-to-face with a dye receiving element. The two are then inserted between a thermal printing head and a platen roller. A line-type thermal printing head is used to apply heat from the back of the dye donor sheet. The thermal printing head has many heating elements and is heated up sequentially in response to one of the cyan, magenta and yellow signals. The process is then repeated for the other two colors. A color hard copy is thus obtained which corresponds to the original picture viewed on a screen.

Thermal prints are susceptible to retransfer of dyes to adjacent surfaces and to discoloration by fingerprints. This is due to dye being at the surface of the dye receiving layer of the print. These dyes can be driven further into the dye receiving layer by thermally fusing the print with either hot rollers or a thermal head. This will help to reduce dye retransfer and fingerprint susceptibility, but does not eliminate these problems. The application of a protective overcoat, however, will practically eliminate these concerns.

U.S. Pat. No. 4,522,881 discloses a protective cover film for thermal dye transfer prints comprising a UV protective layer but gives no guidance for the selection of binder resins to optimize print gloss.

U.S. Pat. No. 5,332,713 discloses a dye donor element for thermal dye transfer, and more particularly to the use of a transferable protection overcoat in the element for transfer to a thermal print. The dye donor element includes a support with at least one dye layer area comprising an image dye in a binder and another area comprising a transferable protection layer of approximately equal size. The transferable protection layer comprises poly(vinyl formal), poly(vinyl benzal) or poly(vinyl acetal) containing at least about 5 mole % hydroxyl. There is a problem with these materials, however, in that they provide inferior gloss and iridescence performance due to refractive index mismatch with the dye receiving layer.

U.S. Pat. No. 5,387,573 relates to a dye donor element for thermal dye transfer, and more particularly to the use of particles in a transferable protection overcoat in the element for transfer to a thermal print. The dye donor element includes a support having bearing at least one dye layer area comprising an image dye in a binder and another area comprising a transferable protection layer of approximately equal size. The transferable protection layer contains particles in an amount of up to about 75% of the thickness of the transferable protection layer. Although the particles eliminate the iridescence problems of the prior art, the particles lower the gloss of the imaged print.

U.S. Pat. No. 5,514,637 relates to a dye donor element for thermal dye transfer, and more particularly to the use of a transferable polymeric protection overcoat having a certain molecular weight in the element for transfer to a thermal print. The dye donor element includes a support bearing at least one dye layer area comprising an image dye in a binder and another area comprising a transferable protection layer of approximately equal size. The transferable protection layer comprises poly(vinyl benzal) having a polymethylmethacrylate equivalent molecular weight of less than about 75,000 as measured by size exclusion chromatography or poly(vinyl acetal) having a polymethylmethacrylate equivalent molecular weight of less than about 65,000 as measured by size exclusion chromatography. Although this overcoat provides a clean break-off performance between transferred and non-transferred laminate, gloss performance is poor.

U.S. Pat. No. 5,668,081 discloses a protective sheet comprising poly(vinyl formal), poly(vinyl benzal) or poly(vinyl acetal) containing at least about 5 mole % hydroxyl, and a cross-linking agent, or a phenoxy resin and a cross-linking agent. These laminates provide improved chemical degradation sensitivity, but they are difficult to manufacture. These non-benzoated phenoxy resins show poor solubility in the solvents desirable for cost-saving, such as methanol and toluene.

U.S. Pat. No. 5,670,449 discloses the use of elastomeric beads in a protective overcoat for better raw-stock keeping, but the gloss performance of these laminates is not optimum.

U.S. Pat. No. 6,942,956 discloses a protective laminate comprising a gloss-enhancing agent, and a mixture of inorganic and organic particles. In a preferred embodiment of the invention, the protection layer contains from about 5% to about 60% by weight inorganic particles, from about 25% to about 80% by weight polymeric binder and from about 5% to about 60% by weight of organic particles, and an effective amount of at least one gloss-enhancing compound. The gloss enhancing compound consists of an organic molecule that is essentially colorless, does not scatter light, is substantially not absorbing of light at a wavelength from 400 to 800 nm, and has a maximum absorption at a wavelength less than 400 nm. The inorganic particles, e.g. silica, are required to provide smooth laminate tear-off, but these degrade gloss and are detrimental to the gravure coating quality. The organic particles are required to reduce iridescence, but these reduce gloss. The gloss improvement provided is not adequate.

U.S. Pat. Application No. 2006/0068174 discloses a protective sheet comprising a peeling layer and an adhesive layer, with specific refractive index requirements between the two layers to prevent iridescence. This two-layer laminate adds to manufacturing cost, and is not optimum for both gloss and image stability.

U.S. Pat. No. 6,733,611 discloses the use of a transferable protection layer containing a resin having a Tg value of 40-100° C. and a storage modulus at 110° C. of not more than $1\times10^5$ Pa, but makes no mention of cut edge quality or material solubility.

Japanese Pat. No. 2,825,778 discloses a protective laminate comprising an ultraviolet absorber with methyl methacrylate, styrene acrylate, a cellulosic resin or a mixture thereof having a glass transition point of 100° C. These acrylate laminates have poor physical properties, and styrene-containing laminate give poor barrier properties for pollutant gases.

Japanese Kokai No. 2006/021402 discloses a protective sheet comprising an acrylate copolymer resin, but these laminates have inadequate physical properties.

Japanese Kokai No. 2006/095982 discloses a protective sheet to prevent iridescence with a transferable layer of a material with a specific refractive index range which depends on the film thickness, but the resins disclosed are not optimum for both gloss and image stability.

PROBLEM TO BE SOLVED

There remains a need for a thermally transferable protection overcoat for dye diffusion thermal transfer media which produces final prints with improved gloss, reduced iridescence, reduced fade due to pollutant gases, particularly nitrogen dioxide ($NO_2$), improved edge tear during separation of finished print from the donor, can be manufactured using low-cost solvents, and provides trouble-free roll winding properties during manufacturing.

SUMMARY OF THE INVENTION

The present invention relates to a protective heat transferable overcoat element comprising a support having thereon a protective polymer layer of at least one benzoated phenoxy resin of Formula I:

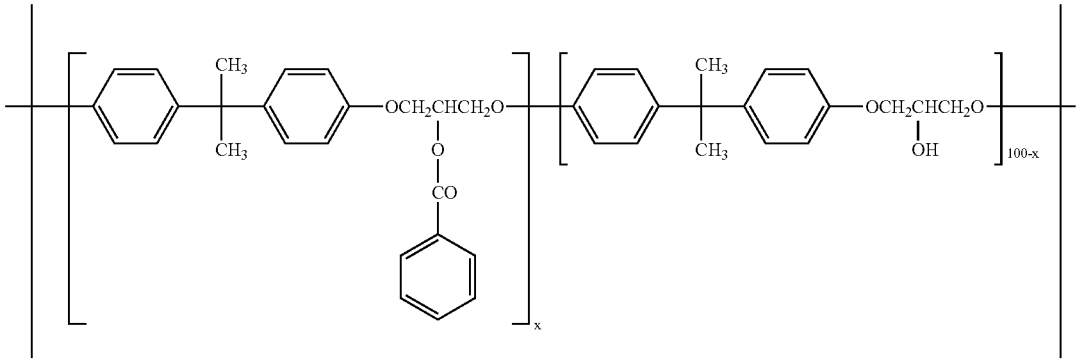

wherein x is from 10-100. The present invention also relates to a thermal transfer dye donor element comprising a support having on one side thereof at least one dye layer and a protective polymer layer of at least one benzoated phenoxy resin of Formula I:

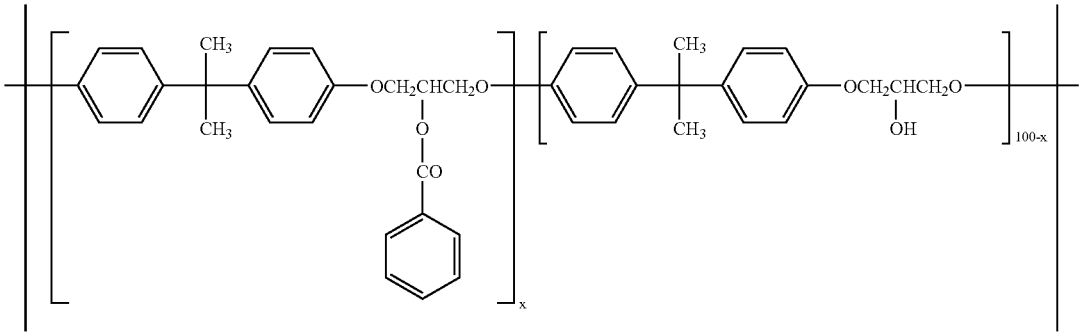

wherein x is from 10-100 and a thermal transfer assemblage comprising at least one thermal transfer donor element comprising a support having on one side thereof a protective polymer layer of at least one benzoated phenoxy resin of Formula I:

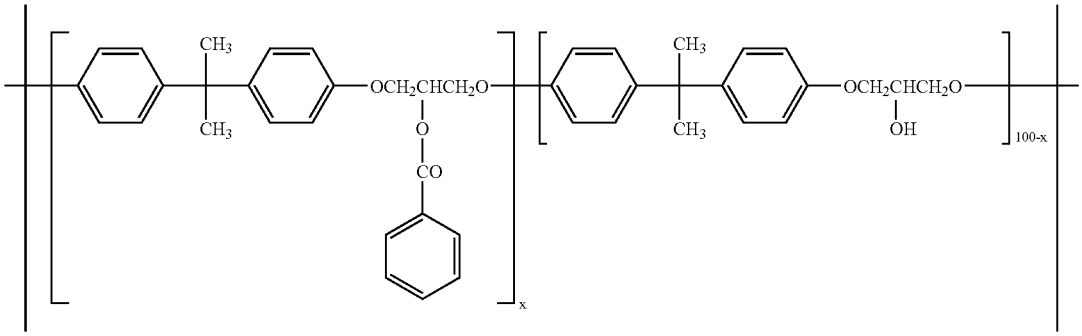

wherein x is from 10-100, and an image receiving element comprising a support having on one side thereof an image receiving layer, the image receiving element being in a superposed relationship with the thermal transfer donor element so that the side having said protective polymer layer is in contact with the image receiving layer of the receiving element. Finally, the present invention relates to a protected image reproduction comprising a support, an imaging layer containing an image, and a transferred protective heat transferable overcoat comprising a protective polymer layer of at least one benzoated phenoxy resin of Formula I:

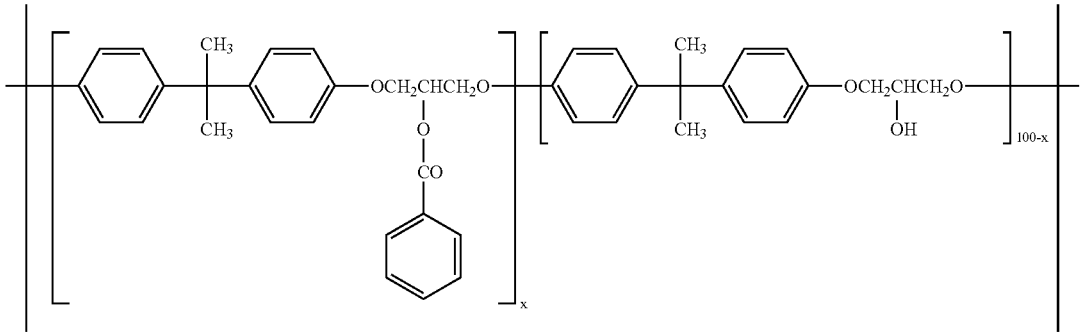

wherein x is from 10-100.

ADVANTAGEOUS EFFECT OF THE INVENTION

The present invention includes several advantages, not all of which are incorporated in a single embodiment. The use of the inventive binder with a close match of refractive indices between the protective laminate and dye receiving layers eliminates iridescence and the necessity for incorporation of divinylbenzene beads. This results in a measurable increase in gloss. The use of the benzoated phenoxy resin significantly reduces dye fade due to nitrogen dioxide ($NO_2$). The use of the benzoated phenoxy resin binder produces a smooth edge tear without the use of colloidal silica, and enables the use of low-cost solvents in manufacturing. The incorporation of crosslinked elastomeric beads enables smooth roll winding without a significant decrease in gloss performance.

DETAILED DESCRIPTION OF THE INVENTION

The present invention relates to a binder for use in dye diffusion thermal transfer media comprising a benzoated phenoxy resin which results in improved gloss of the dye diffusion thermal transfer prints. The benzoated phenoxy resin may be used in a laminate or protective polymer overcoat layer. This layer may further be utilized in a thermal transfer dye donating material and a thermal transfer system utilizing this donor. The laminate or protective polymer overcoat layer may also be included in final prints with enhanced gloss properties. The laminate provides better refractive index matching with the underlying dye receiving layer. In addition to its use in dye diffusion thermal transfer systems, the layer may be used in applications such as, for example, a thermal transfer layer applied to an inkjet receiver.

The application of a protective overcoat can eliminate concerns commonly encountered with dye diffusion thermal transfer prints. In addition, the protective overcoat can also provide improved dye stability by acting as a barrier to UV light and pollutant gases such as ozone and nitrogen dioxide. If desired, the overcoat may also provide the prints with a glossy surface, comparable to that obtained from glossy silver-halide photographic prints, with no iridescence. Preferably, the gloss, when measured at 20°, is at least 60 when transferred at a line time of 1 ms, and at least 58 when transferred at a line time of 0.5 ms. The overcoat laminate desirably results in a smooth tear-off between transferred and non-transferred laminate. For improvements in manufacturing, it is desirable that the materials utilized in the protection laminate allow trouble-free coating and roll winding operations, and the use of low-cost solvents.

The present invention provides a protection overcoat layer on a thermal print by uniform application of heat using a thermal head. The protective overcoat layer, which may also be referred to as a laminate or laminate patch, is made of at least one benzoated phenoxy resin of Formula I:

Formula I

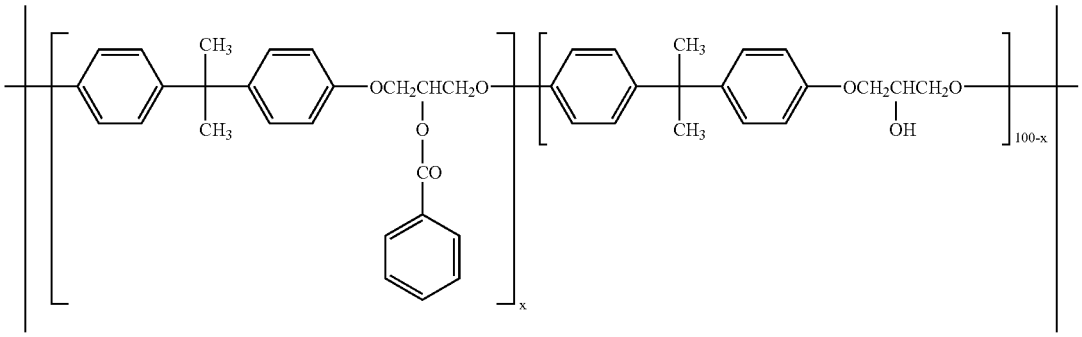

wherein x is from 10-100. The average molecular weight can be in the range 4,000 to 100,000, preferably 15,000 to 80,000.

Benzoated phenoxy resins may be synthesized by reacting phenoxy resins with aryl acid chlorides, such as benzoyl chloride, or with aryl acid anhydrides, such as benzoic anhydride, in the presence of an acid acceptor in a suitable solvent. Tertiary amines such as triethylamine are convenient for use as an acid acceptor. Phenoxy resins are relatively high molecular weight amorphous engineering thermoplastics synthesized from the reaction of diphenols and epichlorohydrin using a strong base. Preferably, the benzoated phenoxy resin is prepared using a phenoxy resin such as the PKHJ resin, from In-Chem (Rock Hill, S.C., USA). In an exemplary preparation, PKHJ resin is dissolved in tetrahydrofuran (THF) at 25° C. Benzoyl chloride is added, the amount is determined by the degree of bezoation desired. Triethylamine is added slowly (over 20 to 30 minutes) while stirring and maintaining temperature at 25° C. The mixture is gently heated to reflux (72° C.) and held for 3 hours, followed by cooling to room temperature. The mixture is added to methanol to precipitate the polymer, and THF is added to redissolve the polymer. The polymer is precipitated by adding ice water, and then dried in vacuum at 65° C. for 48 hours.

In a preferred embodiment of the invention, the dye donor element is a multicolor element comprising repeating color patches of yellow, magenta and cyan image dyes, respectively, dispersed in a binder, and a patch containing the protection layer. In another embodiment of the invention, the protection layer is the only layer on the donor element and is used in conjunction with another dye donor element which contains the image dyes.

Preferably, the resin used in the protective layer comprises a benzoated phenoxy resin that is 10-100% benzoated. When used in a thermal transfer system, the refractive index of the benzoated phenoxy resin can be closely matched to the refractive index of the dye receiving layer to alleviate the low gloss of current laminate, resulting from the mismatch in refractive index between dye receiving layer and the protective laminate. Typically, refractive index is in the range 1.50-1.65, more preferably in the range 1.54-1.65. Use of the benzoated phenoxy resin gives gloss values 18-20 units higher than the gloss values achieved with a poly (vinyl acetal) laminate, as measured with a BYK-Gardner micro-TRI-Gloss® meter (see experimental section).

In one embodiment, the laminate layer may contain crosslinked elastomeric organic beads. The beads can have a glass transition temperature (Tg) of 45° C. or less, for example, 10° C. or less. The elastomeric beads can be made from an acrylic polymer or copolymer, such as butyl-, ethyl-, propyl-, hexyl-, 2-ethylhexyl-, 2-chloroethyl-, 4-chlorobutyl- or 2-ethoxyethyl-acrylate or methacrylate; acrylic acid; methacrylic acid; hydroxyethyl acrylate; a styrenic copolymer, such as styrene-butadiene, styrene-acrylonitrile-butadiene, styrene-isoprene, or hydrogenated styrene-butadiene; or mixtures thereof. The elastomeric beads can be crosslinked with various crosslinking agents, which can be part of the elastomeric copolymer, such as but not limited to divinylbenzene; ethylene glycol diacrylate; 1,4-cyclohexylene-bis(oxyethyl)dimethacrylate; 1,4-cyclohexylene-bis(oxypropyl)diacrylate; 1,4-cyclohexylene-bis(oxypropyl)dimethacrylate; and ethylene glycol dimethacrylate. The elastomeric beads can have from 1 to 40%, for example, from 5 to 40%, by weight of a crosslinking agent. The elastomeric microbeads may be employed in any amount effective for the intended purpose. In general, good results have been obtained at a coverage of from about 10 to about 25 mg/m$^2$. The elastomeric microbeads generally have a particle size of from about 4 μm to about 10 μm. At these levels, the beads are not detrimental to gloss, and are beneficial for finishing operations involving web-transport and spool winding.

The elastomeric beads may be crosslinked with various crosslinking agents, which may also be part of the elastomeric copolymer, such as divinylbenzene; ethylene glycol diacrylate; 1,4-cyclohexylene-bis(oxyethyl)dimethacrylate; 1,4-cyclohexylene-bis(oxypropyl)diacrylate; 1,4-cyclohexylene-bis(oxypropyl)dimethacrylate; ethylene glycol diacrylate; etc.

The glass transition temperatures were determined by the method of differential scanning calorimetry (DSC) at a scanning rate of 20° C./minute and the onset in the change in heat capacity was taken as the Tg.

Following are examples of typical elastomeric microbeads which may be employed in the invention:

Bead 1) poly(butyl acrylate-co-divinylbenzene) (80:20 mole ratio) having a nominal diameter of approximately 4 μm and a Tg of approximately −31° C.

Bead 2) poly(styrene-co-butyl acrylate-co-divinylbenzene) (40:40:20 mole ratio) having a nominal diameter of approximately 4 μm and a Tg of approximately 45° C.

Bead 3) poly(ethyl acrylate-co-ethylene glycol diacrylate) (90:10 mole ratio) having a nominal diameter of approximately 5 μm and a Tg of approximately −22° C.

Bead 4) poly(2-ethylhexyl acrylate-co-styrene-co-divinylbenzene) (45:40:15 mole ratio) having a nominal diameter of approximately 5 μm and a Tg of approximately 20° C.

Bead 5) poly[2-chloroethylacrylate-co-1,4-cyclohexylene-bis(oxypropyl) diacrylate] (80:20 mole ratio) having a nominal diameter of approximately 7 μm and a Tg of approximately −10° C.

Bead 6) poly(butyl methacrylate-co-hydroxyethyl-acrylate-co-divinylbenzene) (65:10:25 mole ratio) having a nominal diameter of approximately 6 μm and a Tg of approximately 29° C.

Bead 7) poly(styrene-co-butadiene-co-divinylbenzene) (40:50:10 mole ratio) having a nominal diameter of approximately 8 μm and a Tg of approximately −55° C.

Bead 8) poly(styrene-co-2-ethoxyethyl acrylate-co-ethylene glycol diacrylate) (20:45:35 mole ratio) having a nominal diameter of approximately 4 μm and a Tg of approximately −5° C.

Bead 9) poly(styrene-co-hexyl acrylate-co-divinylbenzene) (10:70:20 mole ratio) having a nominal diameter of approximately 4 μm and a Tg of approximately −15° C.

The thermally transferable protective layer may be formed by dissolving or dispersing the resin and beads in a suitable solvent, preferably a mixture of toluene and methanol. An ultraviolet (UV) absorber may also be included in the formulation of the protective layer. While any known UV absorber may be used, the preferred material is TINUVIN 460 (Ciba). Although not required for this invention, inorganic particles or organic beads other than the crosslinked elastomeric beads may be added.

The resin formulation is coated onto the support sheet, for example, by gravure printing, screen printing, or reverse coating using a gravure plate, and drying the coating. The protection layer is generally applied at a coverage of at least about 0.03 g/m$^2$ to about 1.7 g/m$^2$ to obtain a dried layer of less than 1 μm. Thicker coatings can be applied if desired, for example in the 2-3 g/m$^2$ range.

In a preferred embodiment of the invention, the protection layer contains, from about 40% to about 90% by weight polymeric binder, typically 80-85%, from about 2-30%, typically 5-20% by weight of the UV absorbing compound, and from about 0.5% to about 3% crosslinked elastomeric beads, typically 0.7-2%.

In use, yellow, magenta and cyan dyes are thermally transferred from a dye donor element to form an image on the dye receiving sheet. The thermal head is then used to transfer the clear protection layer, from a clear patch on the dye donor element or from a separate donor element, onto the imaged receiving sheet by uniform application of heat. The clear protection layer adheres to the print and is released from the donor support in the area where heat is applied.

An adhesive layer may be provided on the surface of the thermally transferable protective layer to improve transferability and adhesion to the receiver surface. The adhesive layer may be formed of any conventional pressure-sensitive adhesive or heat sensitive adhesive having a glass transition temperature (Tg) of 40-80° C. To maintain high gloss and freedom from iridescence, material selection is determined by refractive index matching requirements.

The protective layer may be provided on the substrate sheet through a peel layer. The provision of the peel layer permits the overcoat layer to be more easily transferred from the thermal transfer sheet onto the receiver. The peel layer may comprise, for example, waxes, such as microcrystalline wax, carnauba wax, paraffin wax, Fischer-Tropsh wax, various types of low-molecular weight polyethylene, Japan wax, beeswax, spermaceti, insect wax, wool wax, shellac wax, candelilla wax, petrolactam, partially modified wax, fatty esters, and fatty amides, and thermoplastic resins, such as silicone wax, silicone resin, fluororesin, acrylic resin, polyester resin, polyurethane resin, cellulose resin, vinyl chloride-vinyl acetate copolymer, and nitrocellulose. Further, the peel layer may comprise a binder resin and a releasable material. Binder resins usable herein include thermoplastic resins, for example, acrylic resins, such as polymethyl methacrylate, polyethyl methacrylate, polybutyl acrylate, vinyl resins, such as polyvinyl acetate, vinyl chloride-vinyl acetate copolymer, polyvinyl alcohol, and polyvinylbutyral, and cellulose derivatives, such as ethylcellulose, nitrocellulose, and cellulose acetate, and thermosetting resins, for example, unsaturated polyester resins, polyester resins, polyurethane resins, and aminoalkyd resins. Releasable materials include waxes, silicone wax, silicone resins, melamine resins, fluororesins, fine powders of talc or silica, and lubricants such as surfactants or metal soaps.

The peel layer may be formed by dissolving or dispersing the materials in a suitable solvent to prepare a coating liquid for a peel layer, coating the coating liquid onto a substrate sheet by gravure printing, screen printing, reverse coating using a gravure plate or other means, and drying the coating. The coverage is generally 0.1 to 10 g/m$^2$ on a dry basis.

Any material can be used as the support for the dye donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm. To achieve high gloss performance in the final print, it is important that the surface of the donor support on the side bearing the protective layer is very smooth, preferably with a surface layer having surface roughness, Ra, no greater than 18 nm. Smooth supports facilitate transfer of a smooth protection layer for high gloss.

The dye donor elements of the invention are used to form a dye transfer image. Such a process comprises imagewise heating a dye donor element and transferring a dye image to a dye receiving element to form the dye transfer image. After the dye image is transferred, the protection layer is then transferred on top of the dye image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye donor element comprises a poly(ethylene terephthalate) support coated with sequential repeating areas of yellow, cyan and magenta dye, and the inventive protection layer. The process steps are sequentially performed for each color to obtain a three-color dye transfer image with a protection layer on top. When the process is only performed for a single color, a monochrome dye transfer image is obtained.

In another preferred embodiment of the invention, the dye donor element is a monochrome element and comprises repeating units of two areas, the first area comprising a layer of one image dye dispersed in a binder, and the second area comprising the protection layer.

In another preferred embodiment of the invention, the dye donor element is a black-and-white element and comprises repeating units of two areas, the first area comprising a layer of a mixture of image dyes dispersed in a binder to produce a neutral color, and the second area comprising the protection layer.

Any dye can be used in the dye layer of the dye donor element of the invention provided it is transferable to the dye receiving layer by the action of heat. Especially good results have been obtained with diffusible dyes.

A preferred embodiment for the magenta donor utilizes a magenta dye, alone or in combination, comprising at least a first magenta dye of the following structure I:

(I)

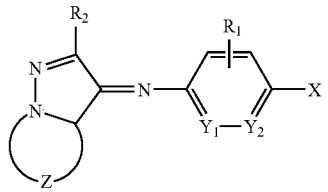

wherein X represents a $NR_3R_4$ group or a hydroxyl group, wherein $R_3$ and $R_4$ may be same or different and are independently selected from an alkyl, alkenyl, aryl, aralkyl, or cycloalkyl group; $Y_1$ and $Y_2$ each independently are selected from a carbon atom or a nitrogen atom, provided that one of $Y_1$ and $Y_2$ is a nitrogen atom; Z represents an atomic group necessary to form a 5- or 6-membered nitrogen-containing heterocyclic ring which may be condensed with another ring; and $R_1$ and $R_2$ are each independently selected from a hydrogen atom, halogen atom, alkyl, alkenyl, alkoxy, alkylamino, acetamido, sulfonamide, aryl, aralkyl, or cycloalkyl group;

and optionally, a second magenta dye of the structure II:

(II)

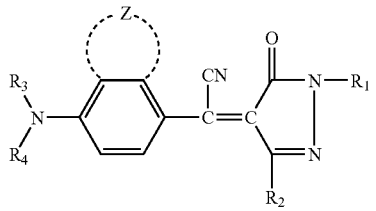

wherein:

$R_1$ represents an alkyl group having from 1 to 10 carbon atoms, a cycloalkyl group having from 5 to 7 carbon atoms, or an aryl group having from 6 to 10 carbon atoms;

$R_2$ represents an alkoxy group having from 1 to 10 carbon atoms, an aryloxy group having from 6 to 10 carbon atoms, naphthoxy, $NHR_5$, $NR_5$, or $R_6$;

$R_3$ and $R_4$ are each independently $R_1$, or either or both of $R_3$ and $R_4$ can be joined to the carbon atom of the aromatic ring at a position ortho to the position of attachment of the anilino nitrogen to form a 5- or 6-membered ring, or $R_3$ and $R_4$ can be joined together to form a 5- or 6-membered heterocyclic ring with the nitrogen to which they are attached;

$R_5$ and $R_6$ each independently represents an alkyl group having from 1 to 10 carbon atoms, a cycloalkyl group having from 5 to 7 carbon atoms, or an aryl group having from 6 to 10 carbon atoms, or $R_5$ and $R_6$ may be joined together to form, along with the nitrogen to which they are attached, a 5- or 6-membered heterocyclic ring; and Z represents hydrogen or the atoms necessary to complete a 5- or 6-membered ring. Additional magenta dyes can be added to the composition.

One or more dyes of structure I can be included in a total amount of from 10 to 90% by weight of the composition, for example, from 15 to 90% by weight, or from 25 to 75% by weight of the composition. Structure I is as follows:

(I)

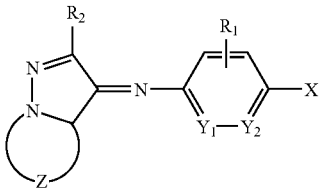

wherein X represents a $NR_3R_4$ group or a hydroxyl group, wherein $R_3$ and $R_4$ may be same or different and are independently selected from an alkyl, alkenyl, aryl, aralkyl, or cycloalkyl group; $Y_1$ and $Y_2$ each independently are selected from a carbon atom or a nitrogen atom, provided that one of $Y_1$ and $Y_2$ is a nitrogen atom; Z represents an atomic group necessary to form a 5- or 6-membered nitrogen-containing heterocyclic ring which may be condensed with another ring; and $R_1$ and $R_2$ are each independently selected from a hydrogen atom, halogen atom, alkyl, alkenyl, alkoxy, alkylamino, acetamido, sulfonamide, aryl, aralkyl, or cycloalkyl group. According to certain embodiments, Structure I, $Y_1$ can be a carbon atom, $Y_2$ can be a nitrogen atom, X can be an $NR_3R_4$ group wherein $R_3$ and $R_4$ may be same or different alkyl, Z can be a 5-membered nitrogen-containing heterocyclic ring, $R_1$ can be a hydrogen or alkyl group, and $R_2$ can be an alkyl group.

The dye of structure I can be as follows:

(Ia)

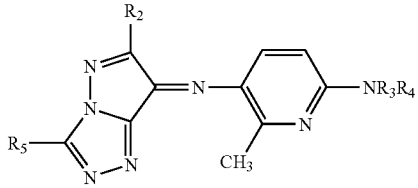

wherein $R_3$ and $R_4$ can be the same or different and are independently selected from an alkyl and an alkenyl; $R_2$ can be a $C_{1-6}$ alkyl; and $R_5$ can be a $C_{1-10}$ alkyl group, a $C_{5-7}$ cycloalkyl group, or a $C_{6-10}$ aryl group. According to certain embodiments, the dye of structure I can be as follows:

(Ib)

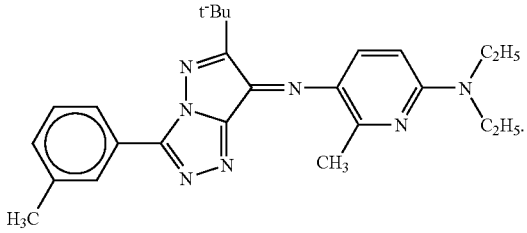

Methods of forming the dye of structures I, Ia and Ib are known in the art and can be found, for example, in U.S. Pat. Nos. 5,476,943 and 5,532,202, incorporated herein by reference.

A magenta dye of structure II can be included in the composition. One or more dyes of structure II can be included in a total amount of from 10 to 90% by weight of the composition, for example, from 10 to 85% by weight, or from 25 to 75% by weight of the composition. The magenta dye of structure II has the following formula:

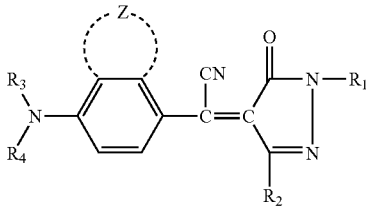

wherein:

$R_1$ represents an alkyl group having from 1 to 10 carbon atoms, a cycloalkyl group having from 5 to 7 carbon atoms, or an aryl group having from 6 to 10 carbon atoms;

$R_2$ represents an alkoxy group having from 1 to 10 carbon atoms, an aryloxy group having from 6 to 10 carbon atoms, naphthoxy, $NHR_5$, $NR_5$, or $R_6$;

$R_3$ and $R_4$ are each independently $R_1$, or either or both of $R_3$ and $R_4$ can be joined to the carbon atom of the aromatic ring at a position ortho to the position of attachment of the anilino nitrogen to form a 5- or 6-membered ring, or $R_3$ and $R_4$ can be joined together to form a 5- or 6-membered heterocyclic ring with the nitrogen to which they are attached;

$R_5$ and $R_6$ each independently represents an alkyl group having from 1 to 10 carbon atoms, a cycloalkyl group having from 5 to 7 carbon atoms, or an aryl group having from 6 to 10 carbon atoms, or $R_5$ and $R_6$ may be joined together to form, along with the nitrogen to which they are attached, a 5- or 6-membered heterocyclic ring; and Z represents hydrogen or the atoms necessary to complete a 5- or 6-membered ring.

According to certain embodiments, in structure II, $R_1$ can be phenyl or methyl; $R_3$ and $R_4$ can each independently be selected from methyl or ethyl; and $R_2$ can be $NR_5R_6$, wherein each of $R_5$ and $R_6$ is independently selected from methyl or ethyl. According to certain embodiments, structure II can be as follows:

(IIa)

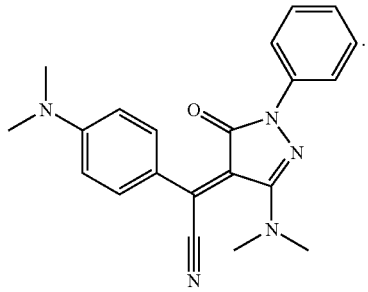

The magenta dye combination can be a combination of structure Ib and structure IIa.

Additional magenta dyes as known in the art can be added to the magenta dye combination including magenta dyes of structures I and II. For example, known magenta dyes include MS Red G (Disperse Red 60, manufactured by Mitsui Toatsu Chemicals, Inc.), Macrolex Violet R (Disperse Violet 26, manufactured by Bayer), and dyes of Structures III and IV. Exemplary additional dyes can include dyes of structure IIIa, IVa, and IVb, or combinations thereof.

Dyes of structure III are as follows:

(III)

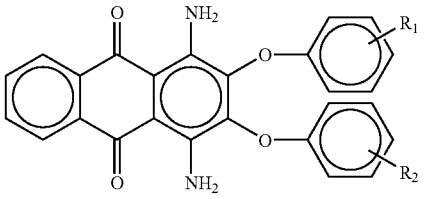

wherein $R_1$ and $R_2$ are each independently selected from hydrogen, hydroxyl, halogen, $C_{1-4}$ alkyl, or $C_{1-4}$ alkoxy.

According to certain embodiments, $R_1$ and $R_2$ can be hydrogen, producing the dye of structure IIIa:

(IIIa)

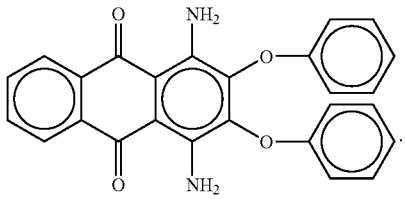

Dyes of structure IV are as follows:

(IV)

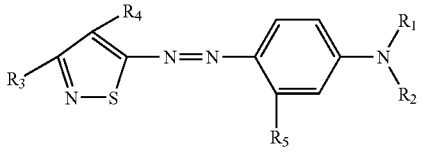

wherein $R_1$ and $R_2$ are each independently hydrogen, $C_{1-6}$ alkyl or allyl, $C_{5-7}$ cycloalkyl, $C_{5-10}$ aryl, or $R_1$ and $R_2$ can be taken together to form a 5- or 6-membered heterocyclic ring which can include the nitrogen to which $R_1$ or $R_2$ is attached, and either carbon atom ortho to the carbon attached to the nitrogen atom;

$R_3$ is a hydrogen, $C_{1-6}$ alkyl, $C_{5-10}$ aryl, alkylthio, or halogen;

$R_4$ is cyano, thiocyanato, alkylthio, or alkoxycarbonyl; and $R_5$ is a $C_{1-6}$ alkyl, a $C_{5-10}$ aryl, or NHA, where A is an acyl or sulfonyl radical. Exemplary dyes of structure IV include:

(IVa)

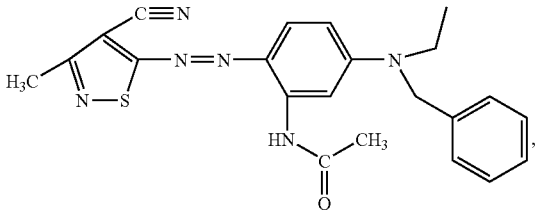

, and (IVb)

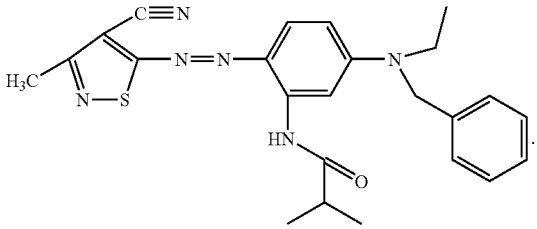

The magenta dye combinations as described herein can be used in a dye donor layer of a thermal dye donor element to form images by thermal printing. The dye donor layer can include the magenta dye combination alone, or multiple colored areas (patches) containing dyes suitable for thermal printing. As used herein, a "dye" can be one or more dye, pigment, colorant, or a combination thereof, and can be in a binder or carrier as known to practitioners in the art. For example, the dye layer can include the magenta dye combination and further comprise a yellow dye donor patch comprising at least one bis-pyrazolone-methine dye and at least one other pyrazolone-methine dye, and a cyan dye donor patch comprising at least one indoaniline cyan dye Any dye transferable by heat can be used in the dye donor layer of the dye donor element. The dye can be selected by taking into consideration hue, lightfastness, and solubility of the dye in the dye donor layer binder and the dye image receiving layer binder. Suitable magenta dye combinations are discussed above.

Examples of sublimable or diffusible dyes include anthraquinone dyes, e.g., Sumikalon Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumickaron Diazo Black 5G® (Sumitomo Chemical Co., Ltd.), and Miktazol Black 5 GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumicacryl Blue 6G® (Sumitomo Chemical Co., Ltd.), and Aizen Malachite Green® (Hodogaya Chemical Co., Ltd.); or any of the dyes disclosed in U.S. Pat. No. 4,541,830, the disclosure of which is hereby incorporated by reference. The dyes may be employed singly or in combination to obtain a monochrome. The dyes may be used at a coverage of from about 0.05 to about 1 g/m$^2$ and are preferably hydrophobic.

Examples of further suitable dyes, including further magenta, yellow, and cyan dyes, can include, but are not limited to, diarylmethane dyes; triarylmethane dyes; thiazole dyes, such as 5-arylisothiazole azo dyes; methine dyes such as merocyanine dyes, for example, aminopyrazolone merocyanine dyes; azomethine dyes such as indoaniline, acetophenoneazomethine, pyrazoloazomethine, imidazoleazomethine, imidazoazomethine, pyridoneazomethine, and tricyanopropene azomethine dyes; xanthene dyes; oxazine dyes; cyanomethylene dyes such as dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyrraleazo, imidazoleazo, thiadiazoleazo, triazoleazo, and disazo dyes; arylidene dyes such as alpha-cyano arylidene pyrazolone and aminopyrazolone arylidene dyes; spiropyran dyes; indolinospiropyran dyes; fluoran dyes; rhodaminelactam dyes; naphthoquinone dyes, such as 2-carbamoyl-4-[N-(p-substituted aminoaryl)imino]-1,4-naphthaquinone; anthraquinone dyes; and quinophthalone dyes. Specific examples of dyes usable herein can include:

C.I. (color index) Disperse Yellow 51, 3, 54, 79, 60, 23, 7, and 141;

C.I. Disperse Blue 24, 56, 14, 301, 334, 165, 19, 72, 87, 287, 154, 26, and 354;

C.I. Disperse Red 135, 146, 59, 1, 73, 60, and 167;

C.I. Disperse Orange 149;

C.I. Disperse Violet 4, 13, 36, 56, and 31;

C.I. Disperse Yellow 56, 14, 16, 29, and 231;

C.I. Solvent Blue 70, 35, 36, 50, 49, 111, 105, 97, and 11;

C.I. Solvent Red 135, 81, 18, 25, 19, 23, 24, 143, 146, and 182;

C.I. Solvent Violet 13;

C.I. Solvent Black 3; and

C.I. Solvent Green 3.

Another preferred embodiment utilizes a cyan dye, alone or in combination, comprising at least a first cyan dye of the following structure XX:

(XX)

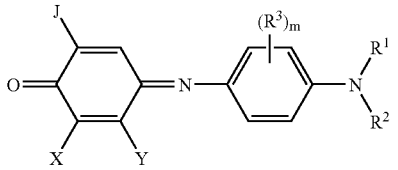

wherein: $R^1$ and $R^2$ each independently represents hydrogen; an alkyl group having from 1 to about 6 carbon atoms; a cycloalkyl group having from about 5 to about 7 carbon atoms; allyl; or such alkyl, cycloalkyl or allyl groups substituted with one or more groups such as alkyl, aryl, alkoxy, aryloxy, amino, halogen, nitro, cyano, thiocyano, hydroxy, acyloxy, acyl, alkoxycarbonyl, aminocarbonyl, alkoxycarbonyloxy, carbamoyloxy, acylamido, ureido, imido, alkylsulfonyl, arylsulfonyl, alkylsulfonamido, arylsulfonamido, alkylthio, arylthio, trifluoromethyl, etc., e.g., methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, cyclohexyl, cyclopentyl, phenyl, pyridyl, naphthyl, thienyl, pyrazolyl, p-tolyl, p-chlorophenyl, m-(N-methyl-sulfamoyl)phenylmethyl, methylthio, butylthio, benzylthio, methanesulfonyl, pentanesulfonyl, methoxy, ethoxy, 2-methane-sulfonamidoethyl, 2-hydroxyethyl, 2-cyanoethyl, methoxy-carbonyl-methyl, imidazolyl, naphthyloxy, furyl, p-tolylsulfonyl, p-chlorophenylthio, m-(N-methyl sulfamoyl)phenoxy, ethoxycarbonyl, methoxyethoxycarbonyl, phenoxycarbonyl, acetyl, benzoyl, N,N-dimethylcarbamoyl, dimethylamino, morpholino, anilino, pyrrolidino etc.; each $R^3$ independently represents hydrogen, substituted or unsubstituted alkyl, cycloalkyl or allyl for $R^1$ and $R^2$; alkoxy, aryloxy, halogen, thiocyano, acylamido, ureido, alkylsulfonamido, arylsulfonamido, alkylthio, arylthio or trifluoromethyl; or any two of $R^3$ may be combined together to form a 5- or 6-membered carbocyclic or heterocyclic ring; or one or two of $R^3$ may be combined with either or both of $R^1$ and $R^2$ to complete a 5- to 7-membered ring; m is an integer of from 0 to 4; X represents hydrogen, halogen or may be combined together with Y to represent the atoms necessary to complete a 6-membered aromatic ring, thus forming a fused bicyclic quinoneimine, such as a naphthoquinoneimine; J represents $NHCOR^4$, $NHCO_2R^4$, $NHCONHR^4$ or $NHSO_2R^4$; and with the proviso that when X is combined with Y, then J represents $CONHR^4$, $SO_2NHR^4$, CN, $SO_2R^4$ or SCN, in which case, however, $R^4$ cannot be hydrogen; $R^4$ is the same as $R^1$ or represents an aryl group having from about 6 to about 10 carbon atoms; a hetaryl group having from about 5 to about 10 atoms; or such aryl or hetaryl groups substituted with one or more groups for $R^1$ and $R^2$; and Y is the same as $R^4$, or acylamino or may be combined together with X.

Other suitable cyan dyes can include Kayaset Blue 714 (Solvent Blue 63, manufactured by Nippon Kayaku Co., Ltd.), Phorone Brilliant Blue S-R (Disperse Blue 354, manufactured by Sandoz K.K.), and cyan dyes of the structures:

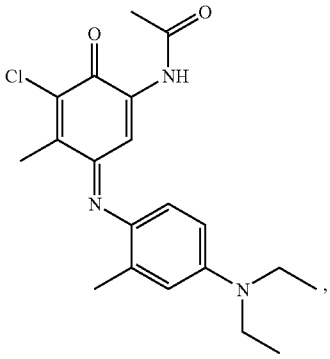

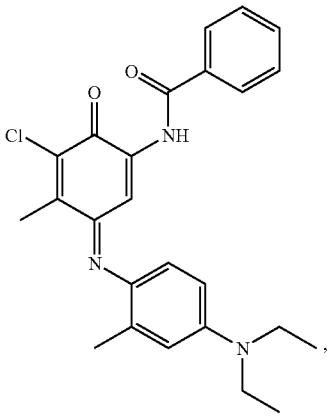

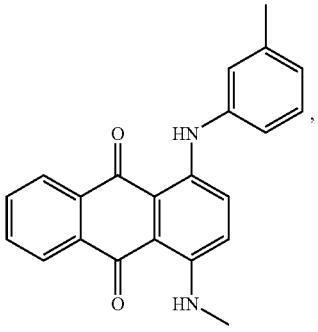

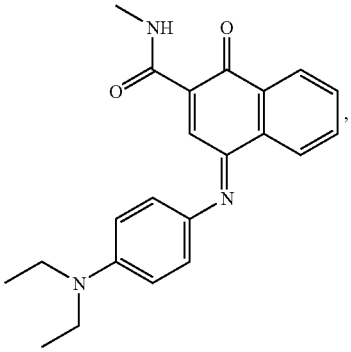

-continued

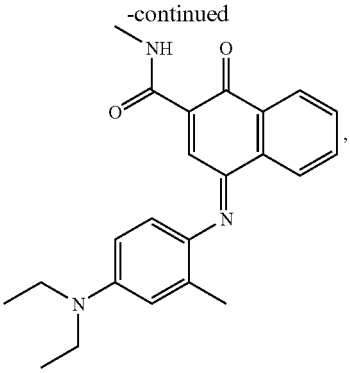

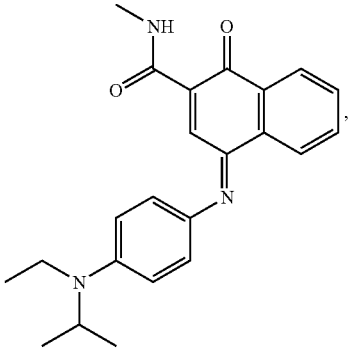

and

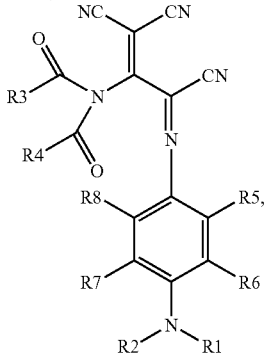

wherein R1 and R2 each independently represents an alkyl group, a cycloalkyl group, an aryl group, a heterocyclic group, or R1 and R2 together represent the necessary atoms to close a heterocyclic ring, or R1 and/or R2 together with R6 and/or R7 represent the necessary atoms to close a heterocyclic ring fused on the benzene ring; R3 and R4 each independently represents an alkyl group, or an alkoxy group; R5, R6, R7 and R8 each independently represents hydrogen, an alkyl group, a cycloalkyl group, an aryl group, an alkoxy group, an aryloxy group, a carbonamido group, a sulfamido group, hydroxy, halogen, $NHSO_2R_9$, $NHCOR_9$, $OSO_2R_9$, or $OCOR_9$, or $R_5$ and $R_6$ together and/or $R_7$ and $R_8$ together represent the necessary atoms to close one or more heterocyclic ring fused on the benzene ring, or R6 and/or R7 together with $R^1$ and/or $R^2$ represent the necessary atoms to close a heterocyclic ring fused on the benzene ring; and $R^9$ represents an alkyl group, a cycloalkyl group, an aryl group and a heterocyclic group.

Another preferred embodiment utilizes a yellow dye, alone or in combination, comprising at least a first yellow dye of the following structure X:

(X)

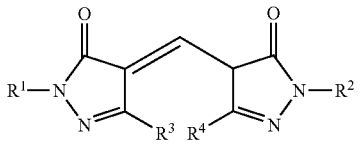

wherein $R^1$ and $R^2$ can be respectively independently selected and are a lower alkyl group which may be substituted, a lower alkenyl group which may be substituted or an aryl group which may be substituted; and $R^3$ and $R^4$ can be respectively independently selected and are a lower alkyl group which may be substituted, a dialkylamino group, a —$COOR^5$ group or a —$CONR^6R^7$ group, in which $R^5$ is a lower alkyl group which may be substituted, a lower alkenyl group which may be substituted or an aryl group which may be substituted and $R^6$ and $R^7$ can be respectively independently selected and are a hydrogen atom, a lower alkyl group which may be substituted, a lower alkenyl group which may be substituted or an aryl group which may be substituted.

A preferred yellow dye of structure X specifically has the following structure:

(Xa)

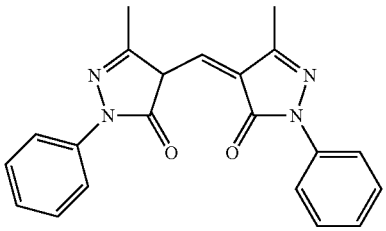

Another preferred embodiment utilizes a yellow dye, alone or in combination, comprising at least a first yellow dye of the following structure XI:

(XI)

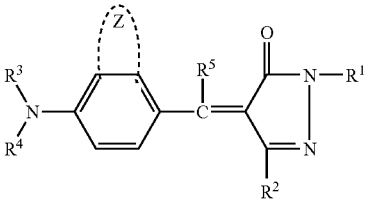

wherein $R^1$ represents a substituted or unsubstituted alkyl group having from 1 to about 10 carbon atoms; a cycloalkyl group having from about 5 to about 7 carbon atoms or an aryl group having from about 6 to about 10 carbon atoms; $R^2$ represents a substituted or unsubstituted alkoxy group having from 1 to about 10 carbon atoms; a substituted or unsubstituted aryloxy group having from about 6 to about 10 carbon atoms; $NHR^6$; $NR^6R^7$ or the atoms necessary to complete a 6-membered ring fused to the benzene ring; $R^3$ and $R^4$ each represents $R^1$; or $R^3$ and $R^4$ can be joined together to form, along with the nitrogen to which they are attached, a 5- or 6-membered heterocyclic ring; $R^5$ represents hydrogen; halogen; carbamoyl; alkoxycarbonyl; acyl; a substituted or unsubstituted alkyl or alkoxy group having from 1 to about 10 carbon atoms; a cycloalkyl group having from about 5 to about 7 carbon atoms; an aryl group having from about 6 to about 10 carbon atoms; or a dialkylamino group; $R^6$ and $R^7$ each independently represents a substituted or unsubstituted alkyl group having from 1 to about 10 carbon atoms; a cycloalkyl group having from about 5 to about 7 carbon atoms or an aryl group having from about 6 to about 10 carbon atoms; $R^6$ and $R^7$ may be joined together to form, along with the nitrogen to which they are attached, a 5- or 6-membered heterocyclic ring; and Z represents hydrogen or the atoms necessary to complete a 5- or 6-membered ring.

A preferred yellow dye of structure XI specifically has the following structure:

(XIa)

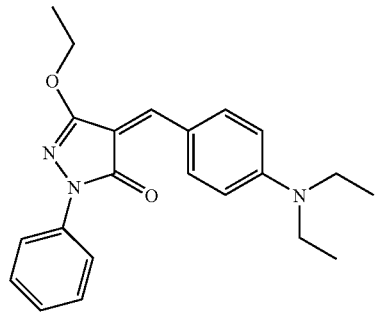

Another preferred embodiment utilizes a yellow dye, alone or in combination, comprising at least a first yellow dye of the following structure XII:

(XII)

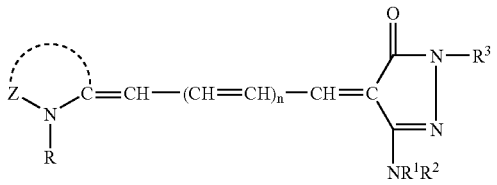

wherein: R represents a substituted or unsubstituted alkyl group of from 1 to about 6 carbon atoms or a substituted or unsubstituted aryl group of from about 6 to about 10 carbon atoms; $R^1$ and $R^2$ each independently represents hydrogen, with the proviso that only one of $R^1$ and $R^2$ may be hydrogen at the same time; a substituted or unsubstituted alkyl group of from 1 to about 6 carbon atoms or a substituted or unsubstituted aryl group of from about 6 to about 10 carbon atoms; or $R^1$ and $R^2$ may be combined together with the nitrogen to which they are attached to form a heterocyclic ring system; $R^3$ is R; n represents 0 or 1; and Z represents the atoms necessary to complete a 5- or 6-membered substituted or unsubstituted heterocyclic ring.

A preferred yellow dye of structure XII specifically has the following structure:

(XIIa)

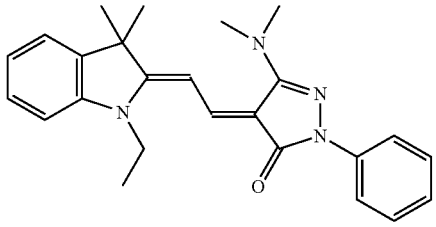

Another preferred embodiment utilizes a yellow dye, alone or in combination, comprising at least a first yellow dye of the following structure XIII:

(XIII)

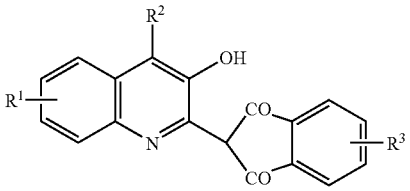

wherein $R_1$ is an alkyl group having 1 to 8 carbon atoms or cycloalkyl group; $R_2$ is a hydrogen atom, halogen atom, alkoxy group which may be substituted, alkylthio group which may be substituted or arylthio group which may be substituted; $R_3$ is a branched alkyl group having 3 to 5 carbon atoms, an O-substituted oxycarbonyl group, an N-substituted aminocarbonyl group in which the N-substituted group may form a ring, or a substituted or unsubstituted heterocyclic ring having two or more hetero atoms of one or more kinds selected from the group consisting of a nitrogen atom, oxygen atom and sulfur atom.

A preferred yellow dye of structure XIII specifically has the following structure:

(XIIIa)

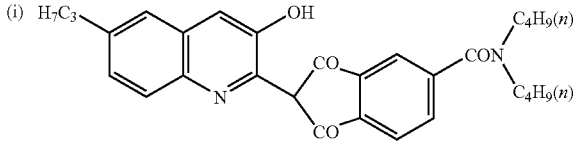

Other suitable yellow dyes can include Phorone Brilliant Yellow S-6 GL (Disperse Yellow 231, manufactured by Sandoz K.K.) and Macrolex Yellow 6G (Disperse Yellow 201, manufactured by Bayer), and a yellow dye of the structure:

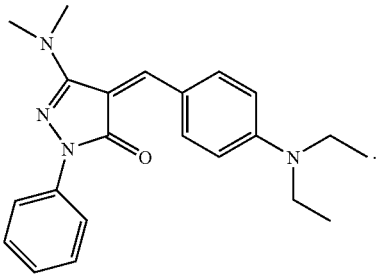

Further examples of useful dyes can be found in U.S. Pat. Nos. 4,541,830; 4,698,651; 4,695,287; 4,701,439; 4,757,046; 4,743,582; 4,769,360; 4,753,922; 4,910,187; 5,026,677; 5,101,035; 5,142,089; 5,374,601; 5,476,943; 5,532,202; 5,804,531; 6,265,345, and U.S. Patent Application Publication No. US 2003/0181331, the disclosures of which are hereby incorporated by reference.

The dyes can be employed singly or in combination to obtain a monochrome dye donor layer or a black dye donor layer. The dyes can be used in an amount of from 0.05 g/m$^2$ to 1 g/m$^2$ of coverage. According to various embodiments, the dyes can be hydrophobic.

Each dye donor layer patch can range from 20 wt. % to 90 wt. % dye, relative to the total dry weight of all components in the layer. A high amount of dye is desirable for increased efficiency, but higher amounts of dye can lead to increased occurrences of donor/receiver sticking. Depending on the efficiency of the dye donor layer, a lower amount of dye can be used to achieve the same efficiency as a different dye donor layer. The dye percent is ideally chosen in view of the specific donor and receiver combination. Varying the amount of dye in the donor can aid in matching the efficiency between different dye patches, for example, a cyan, magenta, and yellow patch. For example, yellow and/or magenta patch dye amounts can be between 20 wt. % and 75 wt. % dye relative to the total dry weight of all components in the layer, for example, between 30 wt. % and 50 wt. %. A cyan patch dye amount can be between 40 wt. % and 90 wt. % dye relative to the total dry weight of all components in the layer, for example, between 55 wt. % and 75 wt. %.

To form each color patch of a dye donor layer, one or more dyes can be dispersed in a polymeric binder. The binder can be used in an amount of from 0.05 g/m$^2$ to 5 g/m$^2$. The polymeric binder can be, for example, a polycarbonate; a polyester; a poly(styrene-co-acrylonitrile); a poly(sulfone); a poly(phenylene oxide); a cellulose derivative such as but not limited to cellulose acetate, cellulose acetate propionate, cellulose acetate butyrate, or cellulose triacetate; or a combination thereof. Preferably the polymeric binder is a cellulose ether or ester, for example, ethyl cellulose.

According to various embodiments, the dye donor layer may or may not contain plasticizer. If plasticizer is used, inclusion of the plasticizer in the dye donor layer can increase dye donor efficiency. The dye donor element can include plasticizers known in the art, such as those described in U.S. Pat. Nos. 5,830,824 and 5,750,465, and references disclosed therein. Suitable plasticizers can be defined as compounds having a glass transition temperature (Tg) less than 25° C., a melting point (Tm) less than 25° C., or both. Plasticizers useful for this invention can include low molecular weight plasticizers and higher molecular weight plasticizers such as oligomeric or polymeric plasticizers. Examples of suitable plasticizers can include aliphatic polyesters, epoxidized oils, chlorinated hydrocarbons, poly(ethylene glycols), poly(propylene glycols), and poly(vinyl ethyl ether) (PVEE). The molecular weight of the plasticizer can be greater than or equal to 450 to minimize transfer of the plasticizer to the dye receiving layer during printing. The plasticizer can be present in an amount of from 1 to 50%, for example, from 5% to 35%, by weight of the binder.

Aliphatic polyesters suitable as plasticizers can be derived from succinic acid, glutaric acid, adipic acid, pimelic acid, suberic acid, azelaic acid, and sebacic acid. The aliphatic polyesters can have one or more functional end groups, for example a carboxyl, hydroxyl, or alkoxyl group, where each alkoxyl group can be from 1 to 18 carbon atoms. Examples of suitable aliphatic polyesters can include Drapex plasticizers (Crompton/Witco Corporation, Middlebury, Conn., USA), such as Drapex 429, and Admex plasticizers (Velsicol Chemical Corporation, Rosemont, Ill., USA) such as Admex 429, and Paraplex G25, Plasthall HA7A, Plasthall P650, Plasthall P-7092, all from CP Hall Company, Chicago, Ill., USA.

Epoxidized oils suitable as plasticizers can include partially or completely epoxidized natural oils, and partially or completely epoxidized derivatized natural oils such as epoxidized soybean oil sold as Paraplex G-60, Paraplex G-62, and Plasthall ESO; epoxidized linseed oil sold as Plasthall ELO; or epoxidized octyl tallate sold as Plasthall S-73, all from C. P. Hall Company.

Chlorinated hydrocarbons suitable for use as plasticizers can include long-chain hydrocarbons or paraffins consisting of methylene, methyl, methane or alkene groups, all of which can have a chlorine substitution. The length of the long-chain hydrocarbon can be between 8 and 30 carbon atoms, for example, between 12 and 24 carbon atoms. The chains can be branched. The amount of chlorine in the paraffin can be between 25 and 75 wt %, for example, between 40 and 70 wt %. Mixtures of chlorinated paraffins can also be used. According to certain embodiments, the chlorinated paraffins can have the formula $C_xH_yC_z$ wherein x is between 11 and 24, y is between 14 and 43, and z is between 3 and 10. Examples of suitable chlorinated hydrocarbons can include Chlorowax liquids sold by Occidental Chemical Corp., Dallas, Tex., USA, and Paroil paraffins sold by Dover Chemical Corp., Dover, Ohio, USA, such as Chlorowax 40 and Paroil 170HV.

Poly(ethylene glycols) and poly(propylene glycols) suitable for use as plasticizers can have unsubstituted end groups (OH), or they can be substituted with one or more functional groups such as an alkoxyl group or fatty acid, where each alkoxyl group or fatty acid can be from 1 to 18 carbon atoms. Examples of suitable poly(ethylene glycols) and poly(propylene glycols) can include TegMer 809 poly(ethylene glycol) from C. P. Hall Co., and PPG #483 poly(propylene glycol) from Scientific Polymer Products, Ontario, N.Y., USA.

The dye donor layer can include beads. The beads can have a article size of from 0.5 to 20 microns, preferably from 2.0 to 15 microns. The beads can act as spacer beads under the compression force of a wound up dye donor roll, improving raw stock keeping of the dye donor roll by reducing the material transferred from the dye donor layer to the slipping layer, as measured by the change in sensitometry under accelerated aging conditions, or the appearance of unwanted dye in the laminate layer, or from the backside of the dye donor element, for example, a slipping layer, to the dye donor layer. The use of the beads can result in reduced mottle and improved image quality. The beads can be employed in any amount effective for the intended purpose. In general, good results have been obtained at a coverage of from 0.003 to 0.20 $g/m^2$. Beads suitable for the dye donor layer can also be used in the slip layer.

The beads in the dye donor layer can be crosslinked, elastomeric beads. The beads in the dye donor layer can be hard polymeric beads. Suitable beads can include divinylbenzene beads, beads of polystyrene crosslinked with at least 20 wt. % divinylbenzene, and beads of poly(methyl methacrylate) crosslinked with at least 20 wt. % divinylbenzene, ethylene glycol dimethacrylate, 1,4-cyclohexylene-bis(oxyethyl) dimethacrylate, 1,4-cyclohexylene-bis(oxypropyl) dimethacrylate, or other crosslinking monomers known to those familiar with the art.

The preferred elastomeric microbeads have a lower Tg and are compressed under the weight of the thermal print head during printing, thereby allowing better contact between the dye-donor and dye receiver elements. When microbeads having a high Tg are used, the microbeads are too rigid and prevent intimate contact between the dye donor and dye receiver during printing, resulting in image mottle and poor image quality. The improved dye donor/dye receiver contact achievable with the low Tg elastomeric microbeads results in reduced mottle and improved image quality. The crosslinked elastomeric beads employed in the invention have a Tg of 45° C. or less, preferably 10° C. or less.

The dye donor layer of the dye donor element can be formed or coated on a support. The dye donor layer composition can be dissolved in a solvent for coating purposes. The dye donor layer can be formed or coated on the support by techniques such as, but not limited to, a gravure process, spin-coating, solvent-coating, extrusion coating, or other methods known to practitioners in the art.

The dye layers and protection layer of the dye donor element may be coated on the support or printed thereon by a printing technique such as a gravure process.

According to various embodiments, a subbing layer, for example, an adhesive or tie layer, a dye-barrier layer, or a combination thereof, can be coated between the support and the dye donor layer. The subbing layer can be one or more layers. Useful subbing layers are described in U.S. Pat. No. 4,695,288 or U.S. Pat. No. 4,737,486, incorporated herein by reference.

The adhesive or tie layer can adhere the dye donor layer to the support. Suitable adhesives are known to practitioners in the art, for example, Tyzor TBT® from E.I. DuPont de Nemours and Company. The dye-barrier layer can include a hydrophilic polymer. The dye-barrier layer can provide improved dye transfer densities.

A dye-barrier layer may be employed in the dye donor elements of the invention to improve the density of the transferred dye. Such dye-barrier layer materials include hydrophilic materials such as those described and claimed in U.S. Pat. No. 4,716,144 by Vanier, Lum and Bowman.

A slipping layer may be used on the back side of the dye donor element of the invention to prevent the printing head from sticking to the dye donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, poly-caprolactone, silicone oil, poly(tetrafluoroethylene), carbowax, poly(ethylene glycols), or any of those materials disclosed in U.S. Pat. Nos. 4,717,711; 4,717,712; 4,737,485; and 4,738,950, all incorporated herein by reference. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

Preferably, the slipping layer formulation most desired for resistive head thermal media incorporates a synergistic combination of lubricants from a friction perspective and in terms of headwear or print head buildup. This preferred slip layer is disclosed in U.S. Pat. No. 7,078,366, incorporated herein by reference. Primarily, it includes dye donor element for thermal dye transfer comprising a support having on one side thereof a dye layer and on the other side a slipping layer comprising a material comprising a maleic anhydride polyethylene graft copolymer and at least one other hydrocarbon wax. There is a dye layer and a protective layer on one side of the donor element and on the other side a slipping layer comprising a lubricating material. The lubricating material comprises a solid polymer derived from a polyolefin and an ethylenically unsaturated carboxylic acid or ester or anhydride thereof; and at least one wax. The polymer may be an alpha-olefin maleic anhydride copolymer, a maleic anhydride polyethylene graft copolymer, a copolymer of an alpha-olefin and isopropyl maleate. The polyolefin is derived from an alpha-olefin containing between about two to about eight carbon atoms, preferably where the alpha-olefin is ethylene and/or propylene. The ethylenically unsaturated carboxylic acids are those having between about 3 to about 12 carbon atoms. The ethylenically unsaturated carboxylic acid, ester or anhydride may be, for example, maleic acid, ethylmaleic acid, propylmaleic acid, isopropyl maleic acid, fumaric acid, methylenemalonic acid, glutaconic acid, itaconic acid, methylitaconic acid, mesacomic acid, citraconic acid, or a mixture thereof, as well as corresponding esters, anhydrides or mixtures of such acids, esters and anhydrides. Preferably, the other wax is an olefinic wax, a saturated hydrocarbon polymer, a linear low molecular weight polyethylene, a branched hydrocarbon with a number average molecular weight of no more than about 10,000 and a melting point or softening point of no more than about 120° C., or a synthetic wax comprising a saturated or unsaturated hydrocarbon. The other wax may be selected from, for example, a mineral wax, a vegetable wax, an animal wax or a synthetic wax that is a saturated or unsaturated hydrocarbon polymer. The ratio of the first wax to the other wax is 5:1 to 1:10. Most preferably, the slipping layer comprises at least three different waxes, the polymer derived from the polyolefin and the ethylenically unsaturated carboxylic acid or ester or anhydride thereof, a highly branched alpha-olefin polymer, and at least one other wax. This slipping layer formulation for resistive head thermal media incorporates a synergistic combination of lubricants from a friction perspective and in terms of headwear buildup. Additional benefits include preventing or reducing folds, especially when used with relatively fast printers, for example at 4 milliseconds or less per line. A still further benefit is the prevention of retransfer of dye from the dye donor during production. Finally, the slip layer is capable of being coated at high speed.

The amount of lubricating material used in the slip layer is dependent, at least in part, upon the type of lubricating material, but can be in the range of from 0.001 to 2 g/m$^2$, although less or more lubricating material can be used as needed. If a polymeric binder is used, the lubricating material can be present in a range of 0.1 to 50 weight %, preferably 0.5 to 40 weight %, of the polymeric binder. In one embodiment, the slipping layer comprises 10 to 80 percent by weight of the polymer derived from a polyolefin and an ethylenically unsaturated carboxylic acid or ester or anhydride thereof, 10 to 80 percent by weight of the highly branched α-olefin polymer, and 10 to 80 percent by weight of a substantially linear wax, based on the total weight of the three waxes.

Any binder may also be used in the slipping layer of the invention provided it will be useful for the intended effect. In a preferred embodiment, polymeric thermoplastic binders are employed. Examples of such materials include, for example, poly(styrene-coacrylonitrile) (70/30 wt. ratio); poly(vinyl alcohol-co-butyral) (available commercially as Butvar 76® by Monsanto Corp.); poly(vinyl alcohol-co-acetal); poly(vinyl alcohol-co-benzal); polystyrene; poly(vinyl acetate); cellulose acetate butyrate; cellulose acetate propionate; cellulose acetate; ethyl cellulose; cellulose triacetate; poly (methylmethacrylate); copolymers of methyl methacrylate; etc. In another preferred embodiment of the invention, the thermoplastic binder is cellulose acetate propionate or polyvinyl acetal.

The amount of the optional binder employed in the slipping layer of the invention is not critical. In general, the binder may be employed in an amount of from about 0.1 to about 2 g/m$^2$.

The dye receiving element that is used with the dye donor element of the invention usually comprises a support having thereon a dye image receiving layer. The support for the image receiving layer may be transparent or reflective. The support may be a transparent film such as a poly(ether sulfone), a polyimide, a cellulose ester such as cellulose acetate, a poly(vinyl alcohol-co-acetal) or a poly(ethylene terephthalate). Opaque, reflective supports can include plain paper, coated paper, synthetic paper, photographic paper support, melt-extrusion-coated paper, and laminated paper, such as biaxially oriented support laminates. Biaxially oriented support laminates suitable for use as receivers are described in U.S. Pat. Nos. 5,853,965; 5,866,282; 5,874,205; 5,888,643; 5,888,681; 5,888,683; and 5,888,714, all, incorporated herein by reference. Biaxially oriented supports can include a paper base and a biaxially oriented polyolefin sheet, for example, polypropylene, laminated to one or both sides of the paper base. The support can be a reflective paper, for example, baryta-coated paper, white polyester (polyester with white pigment incorporated therein), an ivory paper, a condenser paper, or a synthetic paper, for example, DuPont Tyvek® by E.I. DuPont de Nemours and Company, Wilmington, Del. The support can be employed at any desired thickness, for example, from 10 μm to 1000 μm. Exemplary supports for the dye image-receiving layer are disclosed in commonly assigned U.S. Pat. Nos. 5,244,861 and 5,928,990, and in EP-A-0671281, all incorporated by reference. Other suitable supports as known to practitioners in the art can also be used. According to various embodiments, the support can be a composite or laminate structure comprising a base layer and one or more additional layers. The base layer can comprise more than one material, for example, a combination of one or more of a microvoided layer, a foamed layer, a layer with hollow particles, a nonvoided layer, a synthetic paper, a natural paper, and a polymer. The dye image-receiving layer may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

Additional polymeric layers can be present between the support and the dye image-receiving layer. The additional layers can provide coloring, adhesion, antistat properties, act as a dye-barrier, act as a dye mordant layer, or a combination thereof. For example, a polyolefin such as polyethylene or polypropylene can be present. White pigments such as titanium dioxide, zinc oxide, and the like can be added to the polymeric layer to provide reflectivity.

A subbing layer can be used over the polymeric layer in order to improve adhesion to the dye image-receiving layer. This can be called an adhesive or tie layer. Exemplary subbing layers are disclosed in U.S. Pat. Nos. 4,748,150, 4,965,238, 4,965,239, and 4,965,241, which are incorporated by reference. An antistatic layer as known to practitioners in the art can also be used in the receiver element. The receiver element can also include a backing layer. Suitable examples of backing layers include those disclosed in U.S. Pat. Nos. 5,011,814 and 5,096,875, which are incorporated by reference.

The dye image-receiving layer, or an overcoat layer thereon, can contain a release agent, for example, a silicone or fluorine based compound, as is conventional in the art. Various exemplary release agents are disclosed, for example, in U.S. Pat. Nos. 4,820,687 and 4,695,286, the disclosure of which are incorporated herein by reference.

The receiver element can also include stick preventative agents, as described for the donor element. The receiver element and dye donor element can include the same stick preventative agent.

The dye image-receiving layer can be formed on the support by any method known to practitioners in the art, including but not limited to printing, solution coating, dip coating, and extrusion coating. When the dye image-receiving layer is extruded, the process can include (a) forming a melt comprising a thermoplastic material; (b) extruding or coextruding the melt as a single-layer film or a layer of a composite (multilayer or laminate) film; and (c) applying the extruded film to the support for the receiver element. Exemplary extruded receiving layer formats are disclosed in U.S. Patent Application Publication 2004/166343, and in U.S. Pat. Nos. 7,091,157. 7,005,406, 6,893,592, and 6,897,183, the disclosure of which are incorporated by reference.

The dye donor element can include a stick preventative agent to reduce or eliminate sticking between the dye donor element and the receiver element during printing. The stick preventative agent can be present in any layer of the dye donor element, so long as the stick preventative agent is capable of diffusing through the layers of the dye donor element to the dye donor layer, or transferring from the slip layer to the dye donor layer. For example, the stick preventative agent can be present in one or more patches of the dye donor layer, in the support, in an adhesive layer, in a dye-barrier layer, in a slip layer, or in a combination thereof. According to various embodiments, the stick preventative agent can be in the slip layer, the dye donor layer, or both. According to various embodiments, the stick preventative agent is in the dye donor layer. The stick preventative agent can be in one or more colored patches of the dye donor layer, or a combination thereof. If more than one dye patch is present in the dye donor layer, the stick preventative agent can be present in the last patch of the dye donor layer to be printed, typically the cyan layer. However, the dye patches can be in any order. For example, if repeating patches of cyan, magenta, and yellow are used in the dye donor element, in that respective order, the yellow patches, as the last patches printed in each series, can include the stick preventative agent. The stick preventative agent can be a silicone- or siloxane-containing polymer. Suitable polymers can include graft copolymers, block polymers, copolymers, and polymer blends or mixtures. Suitable stick preventative agents are described, for example, in U.S. Pat. No. 7,067,457, incorporated herein by reference.

Release agents as known to practitioners in the art can also be added to the dye donor element, for example, to the dye donor layer, the slip layer, or both. Suitable release agents can include, for example, those described in U.S. Pat. Nos. 4,740,496 and 5,763,358, incorporated herein by reference.

Thermal printing heads, which can be used to transfer dye from the dye donor elements of the invention, are available commercially. There can be employed, for example, a Fujitsu Thermal Head FTP-040 MCSOO1, a TDK Thermal Head LV5416 or a Rohm Thermal Head KE 2008-F3.

A thermal dye transfer assemblage of the invention comprises (a) a dye donor element, and (b) a dye receiving element, the dye receiving element being in a superposed relationship with the dye donor element so that the dye layer of the donor element is in contact with the dye image-receiving layer of the receiving element.

The assemblage comprising these two elements may be pre-assembled as an integral unit when a monochrome image is to be obtained. This may be done by temporarily adhering the two elements together at their margins. After transfer, the dye receiving element is then peeled apart to reveal the dye transfer image.

When a three-color image is to be obtained, the assemblage is formed on three occasions during the time when heat is applied by the thermal printing head. After the first dye is transferred, the elements are peeled apart. A second dye donor element (or another area of the donor element with a different dye area) is then brought in register with the dye receiving element and the process is repeated. The third color is obtained in the same manner. Finally, the protection layer is applied on top.

EXAMPLES

The following examples are provided to illustrate the invention.

Receiving Element

Receiver R-1 was used throughout these experiments, having an overall thickness of about 220 μm and a thermal dye receiver layer thickness of about 3 μm. R-1 was prepared by melt extruding the tie layer and dye receiving layer onto the prepared paper support.

| R-1 |
|---|
| Co-extruded polyester-polycarbonate-silicone dye receiving layer |
| PELESTAT 300 (Sanyo Chemical Industries, Ltd.) tie layer |
| Microvoided composite film OPPalyte 350 K18 (ExxonMobil) |
| Pigmented polyethylene |
| Cellulose Paper |
| Polyethylene |
| Polypropylene film |

Experiment 1

Dye Donor Element

KODAK Professional EKTATHERM ribbon, catalogue # 106-7347, was used in a KODAK Thermal Photo Printer, model number 6850, with receiver R-1 to produce maximum density (Dmax) black prints on the receiver, by successively transferring yellow, magenta, and cyan dyes. The protective laminate patch on the donor ribbon was not transferred. Using an experimental Thermal printer designed to reproduce the characteristics of the 6850 printer, the Dmax samples of imaged receiver were then laminated with the following protective overcoats. The transfer line-time for the protective overcoat was 1 ms for the data in Table 1, and 0.5 ms for the data in Table 2.

Protective Overcoat Elements

During production of these examples, the rolls of coated material were assessed for smooth winding characteristics. The solubility of the benzoated and non-benzoated phenoxy resins was measured in a 90/10 mixture of toluene and methanol. These observations are reported in Table 1.

Control Element C-1

Protection layer donor elements were prepared by coating on the back side of a 4.5 μm poly(ethylene terephthalate) support:

1) a subbing layer of titanium alkoxide, Tyzor TBT®, (DuPont Corp.) (0.13 g/m$^2$) from a n-propyl acetate and n-butyl alcohol solvent mixture (85/15), and 2) a slipping layer containing Polywax 400 (Baker-Petrolite Corp.), (0.02 g/m$^2$), Vybar 103, (Baker-Petrolite Corp.), (0.02 g/m$^2$), Ceramer 1608, (Baker-Petrolite Corp.), (0.02 g/m$^2$), poly(vinyl acetal) binder, KS-1, (Sekisui Co.), (0.38 g/m$^2$), coated from a solvent mixture of toluene, methanol and cylcopentanone (75/20/5).

A transferable overcoat layer of poly(vinyl acetal), KS-10, (Sekisui Co.), at a laydown of 0.63 g/m$^2$, colloidal silica, IPA-ST (Nissan Chemical Co.), at a laydown of 0.46 g/m$^2$, UV Absorber TINUVIN 460 (Ciba Specialties Co.), was coated on the front side of the element at a laydown of 0.11 g/m$^2$, and 4 μm divinylbenzene beads at a laydown of 0.03 g/m$^2$. The materials were coated from the solvent 3-pentanone.

Control Element C-2

Control Element C-2 was prepared as control element C-1, except that on the front side of the element, a transferable overcoat layer of poly(vinyl acetal), KS-10, (Sekisui Co.), was coated at a laydown of 0.63 g/m$^2$, colloidal silica, IPA-ST (Nissan Chemical Co.), at a laydown of 0.46 g/m$^2$, and TINUVIN 460 (Ciba Specialties Co.), at a laydown of 0.1 g/m$^2$. The materials were coated from the solvent 3-pentanone.

Control Element C-3

Control Element C-3 was prepared as C-1 except that on the front side of the element, a transferable overcoat layer of phenoxy resin, PKHJ, (InChem. Corp. Rock Hill, S.C.), was coated at a laydown of 0.97 g/m$^2$ and TINUVIN 460 (Ciba Specialties Co.), at a laydown of 0.11 g/m$^2$. The materials were coated from the solvent 3-pentanone.

Inventive Element I-1

Inventive Element I-1 was prepared as control element C-1, except that on the front side of the element, a transferable overcoat layer of PKHJ-Benzoate resin (100% benzoated) was coated at a laydown of 0.97 g/m$^2$ and TINUVIN 460 (Ciba Specialties Co.), at a laydown of 0.11 g/m$^2$. The materials were coated from the solvent 3-pentanone.

Inventive Element I-2

Inventive Element I-2 was prepared the same as control element C-1 except that on the front side of the element, a transferable overcoat layer of PKHJ-Benzoate resin (75% benzoated) was coated at a laydown of 0.97 g/m$^2$ and TINUVIN 460 (Ciba Specialties Co.), at a laydown of 0.11 g/m$^2$. The materials were coated from the solvent 3-pentanone.

Inventive Element I-3

Inventive Element I-3 was prepared the same as control element C-1 except that on the front side of the element, a transferable overcoat layer of PKHJ-Benzoate resin (50% benzoated) was coated at a laydown of 0.97 g/m$^2$ and TINUVIN 460 (Ciba Specialties Co.), at a laydown of 0.11 g/m$^2$. The materials were coated from the solvent 3-pentanone.

Inventive Element I-4

Inventive Element I-4 was prepared the same as control element C-1 except that on the front side of the element, a transferable overcoat layer of PKHJ-Benzoate resin (48% benzoated) was coated at a laydown of 0.97 g/m$^2$ and TINUVIN 460 (Ciba Specialties Co.), at a laydown of 0.11 g/m$^2$. The materials were coated from the solvent 3-pentanone.

Inventive Element I-5

Inventive Element I-5 was prepared the same as control element C-1 except that on the front side of the element, a transferable overcoat layer of PKHJ-Benzoate resin (10% benzoated) was coated at a laydown of 0.97 g/m$^2$ and TINUVIN 460 (Ciba Specialties Co.), at a laydown of 0.11 g/m$^2$. The materials were coated from the solvent 3-pentanone.

Inventive Element I-6

Inventive Element I-6 was prepared the same as control element C-1 except that on the front side of the element, a transferable overcoat layer of PKHJ-Benzoate resin (56% benzoated) was coated at a laydown of 0.97 g/m$^2$ and TINUVIN 460 (Ciba Specialties Co.) was coated at a laydown of 0.11 g/m$^2$. The materials were coated from a solvent mixture of toluene and methanol (90/10).

Inventive Element I-7

Inventive Element I-7 was prepared the same as control element C-1 except that on the front side of the element, a transferable overcoat layer of PKHJ-Benzoate resin (97% benzoated) was coated at a laydown of 0.97 g/m$^2$ and TINUVIN 460 (Ciba Specialties Co.) was coated at a laydown of 0.11 g/m$^2$. The materials were coated from a solvent mixture of toluene and methanol (90/10).

Inventive Element I-8

Inventive Element I-8 was prepared the same as control element C-1 except that on the front side of the element, a transferable overcoat layer of PKHJ-Benzoate resin (56% benzoated) was coated at a laydown of 0.97 g/m$^2$ and TINUVIN 460 (Ciba Specialties Co.), at a laydown of 0.11 g/m$^2$ and 8 μm poly(styrene-co-butyl acrylate-co-divinylbenzene) (40/40/20 mole ratio) elastomeric beads at a laydown of 0.02 g/m$^2$. The materials were coated from a solvent mixture of toluene and methanol (90/10).

After lamination of these protective overcoat elements to Dmax samples of imaged receiver, gloss was measured at 200 using a BYK-Gardner micro-TRI-Gloss® meter. The aperture of the gloss meter was placed parallel to the direction of printing. Samples were visually assessed for iridescence on a scale of 0 (none) to 5 (severe). Additionally, the quality of the lamination edge was assessed after transfer to determine the smoothness of cut-off between transferred and non-transferred material (reported as "Edge Quality" in Table 1).

Dmax density (Status A) was measured with an X-Rite Transmission/Reflection Densitometer (model 820; X-Rite Incorporated). For all samples laminated with 1.0 ms line time, red density, green density, and blue density values were 2.4, 2.3 and 2.3 respectively. For all samples laminated with 0.5 ms line-time, the corresponding densities were 2.4, 2.3, and 2.4.

Table 1 shows data for samples laminated at 1.0 ms line-time

TABLE 1

| Coating | % Benzo-ation Level | 20° Gloss | Iridescence | Edge Quality | Roll winding quality | Resin solubilty in Toluene Methanol (90/10) |
|---|---|---|---|---|---|---|
| C-1 | — | 40 | 3 | Good | Good | Not measured |
| C-2 | — | 53 | 5 | Good | Poor | Not measured |
| C-3 | — | 60 | 0 | Poor | Poor | Poor |
| I-1 | 100 | 62 | 0 | Good | Poor | Very Good |
| I-2 | 75 | 65 | 0 | Good | Poor | Very Good |
| I-3 | 50 | 65 | 0 | Good | Poor | Very Good |
| I-4 | 48 | 62 | 0 | Good | Poor | Very Good |
| I-5 | 10 | 61 | 0 | Good | Poor | Good |
| I-6 | 56 | 65 | 0 | Good | Poor | Very Good |
| I-7 | 97 | 62 | 0 | Good | Poor | Very Good |
| I-8 | 56 | 60 | 0 | Good | Good | Very Good |

Comparing C-1 with C-2, removal of divinylbenzene beads results in improved gloss but very poor iridescence and unacceptable roll winding characteristics. C-3 shows that use of a non-benzoated phenoxy resin gives excellent gloss and iridescence performance, but poor edge quality and inadequate solubility in the preferred Toluene/Methanol mixture. Inventive examples I-1 through I-8, with benzoated resins show excellent gloss and iridescence performance, good edge quality without the use of colloidal silica, and very good solubility of the resin in the preferred Toluene/Methanol mixture. Inventive example I-8, demonstrates all these features and additionally good roll-winding properties due to the use of the elastomeric beads.

Table 2 shows data for samples laminated at 0.5 ms line-time.

TABLE 2

| Coating | % Benzoation Level | 20° Gloss | Iridescence |
|---|---|---|---|
| C-1 | — | 30 | 1 |
| C-2 | — | 48 | 1 |
| I-6 | 56 | 65 | 0 |
| I-7 | 97 | 62 | 0 |
| I-8 | 56 | 59 | 0 |

At the shorter line-transfer time associated with faster printing, the gloss of the C-1 control coating is particularly poor. The inventive examples I-6, I-7, and I-8 demonstrate a 2× improvement in gloss compared to C-1, with no iridescence.

Experiment 2

The cyan dye is the most prone to fade by pollutant gases, as this dye is transferred last in a typical thermal transfer system, and remains closest to the surface of the print. For this reason, it is desirable to identify means to reduce the sensitivity of the cyan dye to pollutant gases. Nitrogen dioxide is present in many city environments, and in homes where wood or coal-burning stoves and fireplaces are present.

KODAK Professional EKTATHERM ribbon, catalogue # 106-7347, was used in a KODAK Thermal Photo Printer, model number 6850, with receiver R-1 to produce patches of cyan images of optical density (OD) ranging from $D_{min}$ (OD<0.2) to $D_{max}$ (OD>2.0). The protective laminate patch on the donor ribbon was not transferred. Using an experimental Thermal printer designed to reproduce the characteristics of the 6850 printer, the cyan samples of imaged receiver were then laminated with the protective overcoats described below. Status A densities were read with the X-Rite densitometer. The printed images were subjected to 1 part per million exposure to nitrogen dioxide, at 25° C., 50% RH, for 5 days, after which the Status A densities were re-read. The percent density loss after fade was calculated from an initial density of 1.0. The results of the nitrogen dioxide testing are shown in Table 3.

Inventive Element I-9

Inventive Element I-9 was prepared the same as control element C-1 except that on the front side of the element, a transferable overcoat layer of PKHJ-Benzoate resin (100% benzoated) was coated at a laydown of 0.97 g/m$^2$ and TINUVIN 460 (Ciba Specialties Co.), at a laydown of 0.11 g/m$^2$ and 8 μm poly(styrene-co-butyl acrylate-co-divinylbenzene) (40/40/20 mole ratio) elastomeric beads at a laydown of 0.02 g/m$^2$. The materials were coated from a solvent mixture of toluene and methanol (90/10).

Inventive Element I-10

Inventive Element I-10 was prepared the same as control element C-1 except that on the front side of the element, a transferable overcoat layer of PKHJ-Benzoate resin (75% benzoated) was coated at a laydown of 0.97 g/m$^2$ and TINUVIN 460 (Ciba Specialties Co.), at a laydown of 0.11 g/m$^2$ and 8 μm poly(styrene-co-butyl acrylate-co-divinylbenzene) (40/40/20 mole ratio) elastomeric beads at a laydown of 0.02 g/m$^2$. The materials were coated from a solvent mixture of toluene and methanol (90/10).

Inventive Element I-11

Inventive Element I-11 was prepared the same as control element C-1 except that on the front side of the element, a transferable overcoat layer of PKHJ-Benzoate resin (50% benzoated) was coated at a laydown of 0.97 g/m$^2$ and TINUVIN 460 (Ciba Specialties Co.), at a laydown of 0.11 g/m$^2$ and 8 μm poly(styrene-co-butyl acrylate-co-divinylbenzene) (40/40/20 mole ratio) elastomeric beads at a laydown of 0.02 g/m$^2$. The materials were coated from a solvent mixture of toluene and methanol (90/10).

Table 3 shows data from the nitrogen dioxide test

TABLE 3

| Coating | % Cyan Image fade from Cyan Dye Density of 1.0 |
|---|---|
| C-1 | 10 |
| I-9 | 8 |
| I-10 | 4 |
| I-11 | 4 |

The inventive overcoats have significantly reduced the amount of cyan fade due to nitrogen dioxide.

The invention has been described in detail with particular reference to certain preferred embodiments thereof, but it will be understood that variations and modifications can be effected within the spirit and scope of the invention.

The invention claimed is:

1. A protective heat transferable overcoat element comprising a support having thereon a protective polymer layer of at least one benzoated phenoxy resin of Formula I:

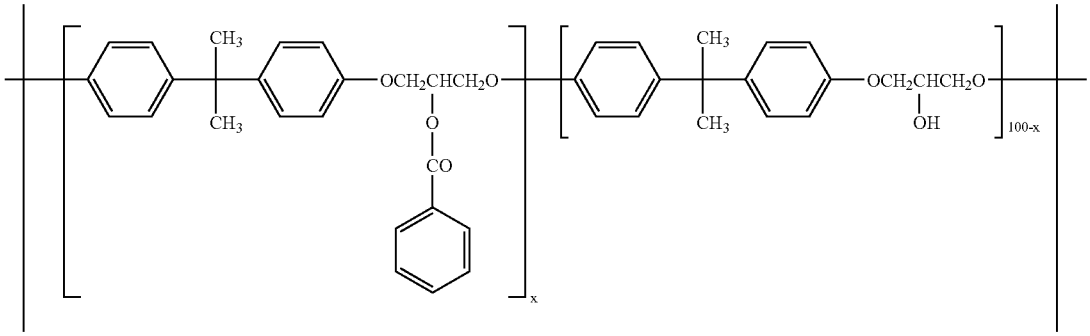

wherein x is from 10-100.

2. The protective heat transferable overcoat element of claim 1 wherein said at least one benzoated phenoxy resin of Formula I is from 10 to 100% benzoated.

3. The protective heat transferable overcoat element of claim 1 wherein said support has a surface roughness, Ra, on the side bearing the protective layer of no greater than 18 nm.

4. The protective heat transferable overcoat element of claim 1 wherein said protective polymer layer is a patch.

5. The protective heat transferable overcoat element of claim 1 wherein said protective polymer layer is a thermal transfer protective polymer layer which is heat transferable in 0.5 ms line-time or less.

6. The protective heat transferable overcoat element of claim 1 wherein said benzoated phenoxy resin has a refractive index of from 1.50 to 1.65.

7. The protective heat transferable overcoat element of claim 1 wherein said protective heat transferable overcoat has a gloss at 200 of at least 60 when transferred at a line time of 1 ms, and at least 58 when transferred at a line time of 0.5 ms.

8. The protective heat transferable overcoat element of claim 1 wherein said protective polymer layer has a coverage of at least 0.03 $g/m^2$ to 1.7 $g/m^2$ to obtain a dried layer of less than 1 μm.

9. The protective heat transferable overcoat element of claim 1 further comprising a subbing layer between said support and said protective polymer layer.

10. The protective heat transferable overcoat element of claim 1 wherein said protective polymer layer is soluble in a mixture of toluene and methanol.

11. The protective heat transferable overcoat element of claim 1 further comprising an ultraviolet (UV) absorbing material.

12. The protective heat transferable overcoat element of claim 11 wherein said ultraviolet (UV) absorbing material is UV-absorbing triazine.

13. The protective heat transferable overcoat element of claim 1 further comprising crosslinked elastomeric organic beads.

14. The protective heat transferable overcoat element of claim 13 wherein said crosslinked elastomeric organic beads have a diameter of from 4-8 μm.

15. The protective heat transferable overcoat element of claim 13 wherein said crosslinked elastomeric organic beads comprise poly(styrene-co-butyl acrylate-co-divinylbenzene).

16. The protective heat transferable overcoat element of claim 1 wherein said protective polymer layer comprises from 40% to 90% by weight of said benzoated phenoxy resin of Formula I, from 2 to 30% ultraviolet (UV) absorbing material, and from 0.5% to 3% crosslinked elastomeric organic beads.

17. The protective heat transferable overcoat element of claim 1 further comprising an adhesive layer on the surface of the thermally transferable protective layer.

18. A thermal transfer dye donor element comprising a support having on one side thereof at least one dye layer and a protective polymer layer of at least one benzoated phenoxy resin of Formula I:

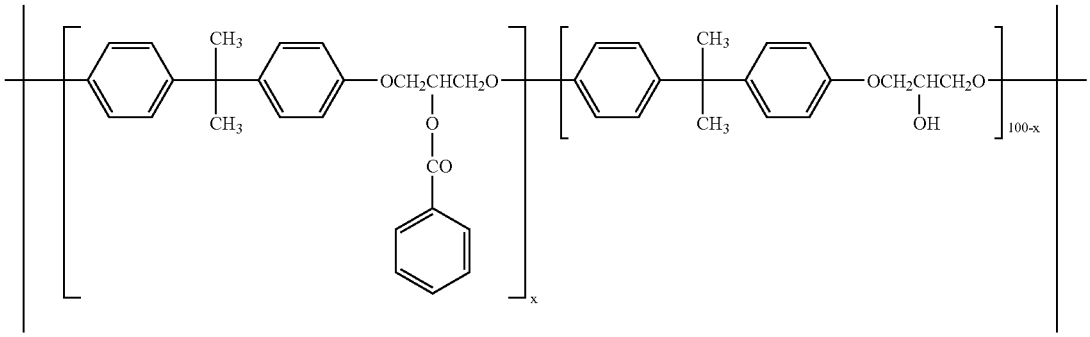

wherein x is from 10-100.

19. The thermal transfer dye donor element of claim 18 wherein said thermal transfer dye donor element is a multicolor element wherein said at least one dye layer comprises repeating color patches of yellow, magenta and cyan image dyes dispersed in a binder, and said protective polymer layer comprises a patch.

20. The thermal transfer dye donor element of claim 18 further comprising a slipping layer on the side of the support opposite said side having at least one dye layer and a protective polymer layer.

21. The thermal transfer dye donor element of claim 18 wherein further comprising a subbing layer between said support and said at least one dye layer.

22. A thermal transfer assemblage comprising at least one thermal transfer donor element comprising a support having on one side thereof a protective polymer layer of at least one benzoated phenoxy resin of Formula I:

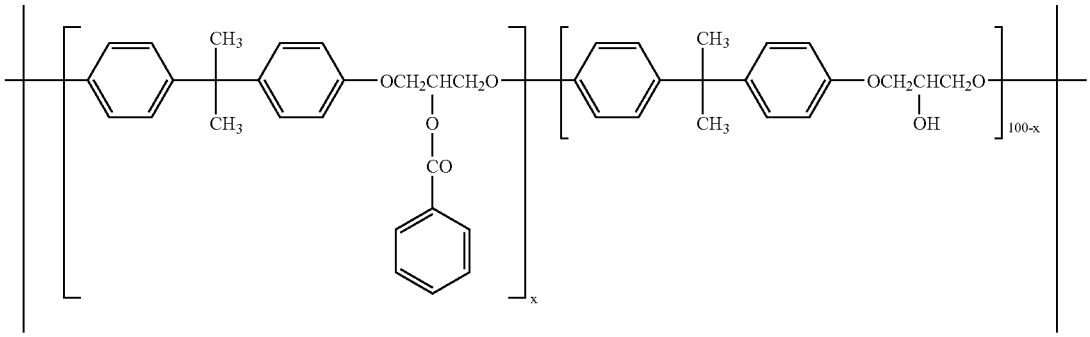

wherein x is from 10-100, and an image receiving element comprising a support having on one side thereof an image receiving layer, the image receiving element being in a superposed relationship with the thermal transfer donor element so that the side having said protective polymer layer is in contact with the image receiving layer of the receiving element.

23. The thermal transfer assemblage of claim 22 wherein said at least one thermal transfer donor element further comprises at least one dye layer on the same side of the support as the protective polymer layer.

24. The thermal transfer assemblage of claim 22 wherein said at least one thermal transfer donor element comprises a first thermal transfer donor element comprising a first support having thereon said protective polymer layer of at least one benzoated phenoxy resin of Formula I, and a second thermal transfer donor element comprising a second support having thereon at least one dye layer.

25. The thermal transfer assemblage of claim 22 wherein said image receiving layer is an inkjet image receiving layer.

26. The thermal transfer assemblage of claim 22 wherein said image receiving layer is an thermal transfer dye image receiving layer.

27. The thermal transfer assemblage of claim 22 wherein the refractive index of said benzoated phenoxy resin of Formula I of said protective polymer layer matches the refractive index of said image receiving layer.

28. A protected image reproduction comprising a support, an imaging layer containing an image, and a transferred protective heat transferable overcoat comprising a protective polymer layer of at least one benzoated phenoxy resin of Formula I:

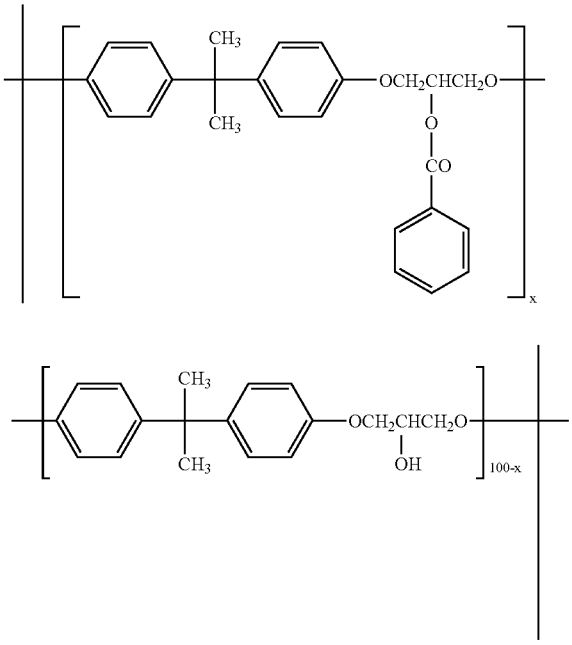

wherein x is from 10-100.

* * * * *

UNITED STATES PATENT AND TRADEMARK OFFICE

CERTIFICATE OF CORRECTION

PATENT NO. : 7,402,365 B1
APPLICATION NO. : 11/739289
DATED : July 22, 2008
INVENTOR(S) : David B. Bailey et al.

It is certified that error appears in the above-identified patent and that said Letters Patent is hereby corrected as shown below:

Col. 33, line 18 Delete "200" and insert --20°--

Signed and Sealed this

Thirtieth Day of December, 2008

JON W. DUDAS
*Director of the United States Patent and Trademark Office*